United States Patent [19]

Blean

[11] Patent Number: 4,795,068

[45] Date of Patent: Jan. 3, 1989

[54] BACKPACK SEAT

[76] Inventor: Harold P. Blean, 225-19th St., NE. #5, East Wenatchee, Wash. 98802

[21] Appl. No.: 98,570

[22] Filed: Sep. 21, 1987

[51] Int. Cl.[4] ..... A45F 4/02

[52] U.S. Cl. ..... 224/155

[58] Field of Search ..... 224/151, 153–156

[56] References Cited

U.S. PATENT DOCUMENTS

| | | | |
|---|---|---|---|
| 1,615,159 | 1/1927 | Bonner | 224/155 |
| 2,031,119 | 2/1936 | Moreland | 224/155 X |
| 2,922,465 | 1/1960 | Johansson et al. | 224/155 |
| 3,730,294 | 5/1973 | Thurmond | 224/155 X |
| 4,450,990 | 5/1984 | Bolstad | 224/155 |

FOREIGN PATENT DOCUMENTS

| | | | |
|---|---|---|---|
| 342611 | 10/1921 | Fed. Rep. of Germany | 224/155 |
| 2128471 | 5/1984 | United Kingdom | 224/155 |

*Primary Examiner*—Henry J. Recla
*Assistant Examiner*—Robert Petrik

[57] ABSTRACT

A backpack frame convertible to a chair through the use of a lightweight conversion assembly that includes a U-shaped member that attaches between the backpack frame and the shoulder straps of the backpack so that the shoulder strap becomes a seat when the pack is leaned against a vertical surface.

The entire conversion assembly is very light and occupies little space and can be readily carried in the backpack or can be permanently attached to the backpack frame.

3 Claims, 2 Drawing Sheets

FIG 3
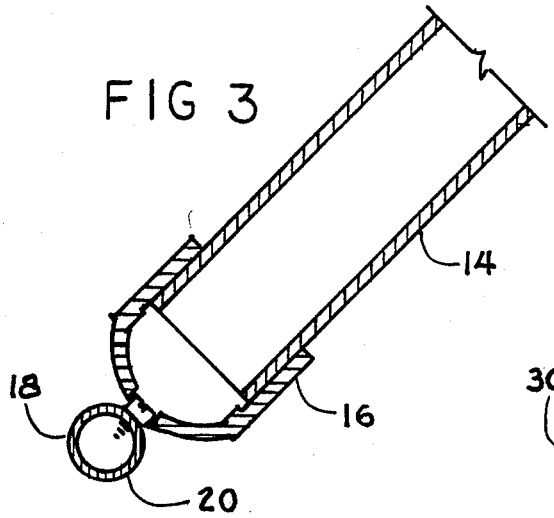
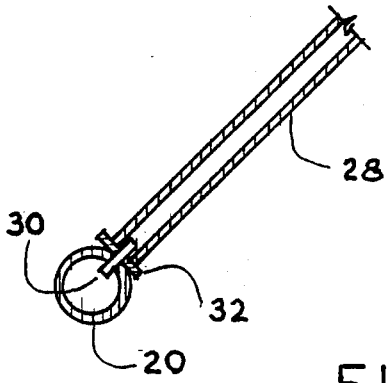
FIG 4
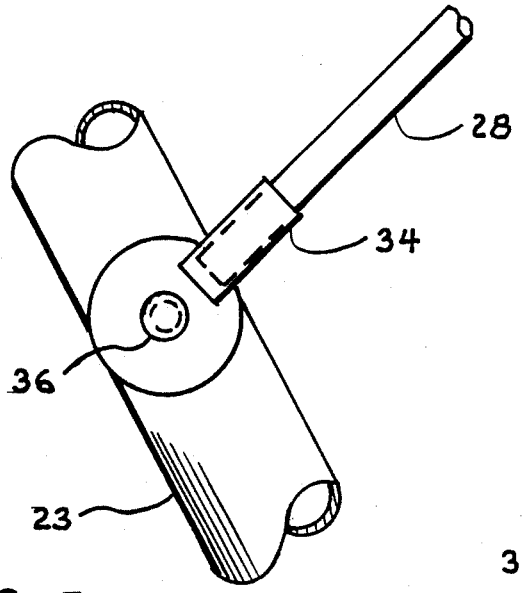
FIG 5
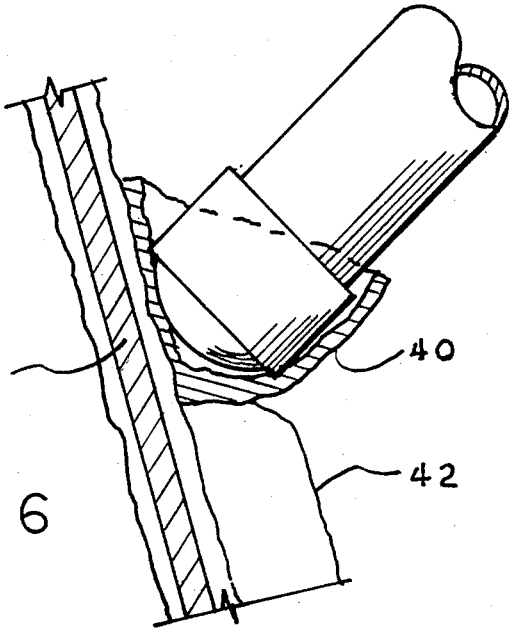
FIG 6

BACKPACK SEAT

BACKGROUND

1. Field of the Invention

The present invention relates to frames for backpacks that are convertible to form a chair or seat and, more particularly, to a lightweight assembly useful in converting several of the more popular types of pack frames available today.

Backpack frames constructed of lightweight tubular members of aluminum or other lightweight material are well known in the art. Such pack frames are typically of a generally rectangular construction, including vertically disposed side frame members and two or more horizontal connecting members. One or more cloth packs or bags, made of nylon, canvas or the like, are attached to the pack frame by means of a variety of demountable connectors. The pack frame, which is typically contoured to fit the user's back and shoulders, is mounted on the user's back by shoulder straps and, to aid in distributing the weight, often a hip belt.

2. Description of Prior Art

The prior art discloses a substantial number and variety of backpack frames which are convertible into chairs or seats. In one general type, the backpack frame is directly openable to form a single seat or chair with a backrest. Examples of such constructions are shown in U.S. Pat. Nos. 2,922,465, 2,031,119, and 1,615,159. Though providing the advantage of quick conversion, these directly convertible pack frames are all characterized by a distinct sacrifice in utility of comfort in either of their intended applications.

It is also known to convert a backpack frame to a chair by partial disassembly, reorientation and reassembly of some of the components. An example of such a construction is disclosed in U.S. Pat. No. 4,450,990. All add complexity and weight when the need is for simplicity and lightness.

SUMMARY OF THE INVENTION

In the present invention, as assembly is provided which is useful in converting several of the more popular types of metal backpack frames into a comfortable camp chair. This conversion assembly is intended to be used with backpack frames of the type having external metal frames or in backpacks having internal metal frames.

The main backpack frame provides the chair back and front legs. Any vertical surface provides the rear support for the frame when the backpack is leaned against it. A U-shaped assembly is added beneath the shoulder straps. The cross member of the U become the front edge of the seat while the legs of the U are pinned to the backpack frame at their free end.

When the shoulder straps are tightened over the U cross member the upper shoulder straps now become a sturdy comfortable seat.

When the lower portion of the shoulder strap is 50% longer than the upper portion the system is stable under a man's weight with no restraint of the U frame required. If the upper and lower strap dimension are nearly equal some attachment between the cross member of the U and the shoulder strap is required to keep the seat from collapsing. A cord or cloth loop in the shoulder strap which the U member passes through can accomplish this.

DRAWING FIGURES

FIG. 3 is a detail of the connection between the legs of the seat frame and a cross bar of the pack frame.

FIG. 4 is same as FIG. 3 except that a metal seat frame is used in lieu of the plastic pipe frame in FIG. 1.

FIG. 5 is a pivoting connection between a metal seat frame and the vertical members of the pack frame. This will allow the seat frame to be folded flush with the pack frame when traveling.

FIG. 6 shows the connection between the legs of the seat frame and the vertical member of an integral frame, type backpack.

DRAWING REFERENCE NUMERALS

10 Cross bar of ½" diam. plastic pipe seat frame.
12 Plastic pipe elbows with slip joints of threaded joints.
14 Legs of seat frame of ½" diam. plastic pipe.
16 End caps for plastic pipe.
17 Hole in end of 16 to receive head of 18.
18 #6×½" tapping screw with fillister head.
19 Any vertical surface such as tree, rock or wall.
20 Backpack frame cross bar.
21 Sack of backpack.
22 Vertical frame of backpack which becomes legs and back of seat when seat frame is in place.
24 Shoulder straps of backpack which becomes seat when seat frame is in place.
26 Shoulder strap adjusting buckles.
28 Seat frame of metal tubing.
30 Pin in end of 28.
32 Washer on end of 28.
34 Socket end for seat frame pivot.
36 Pivot pin through 22 (seat frame can be removed by pulling pivot pins).
38 Metal frame of an internal frame backpack.
40 Fabric or leather sack to receive legs of seat frame.
42 Back pad of internal frame backpack.

DESCRIPTION OF THE PREFERRED EMBODIMENTS

Figure 1:
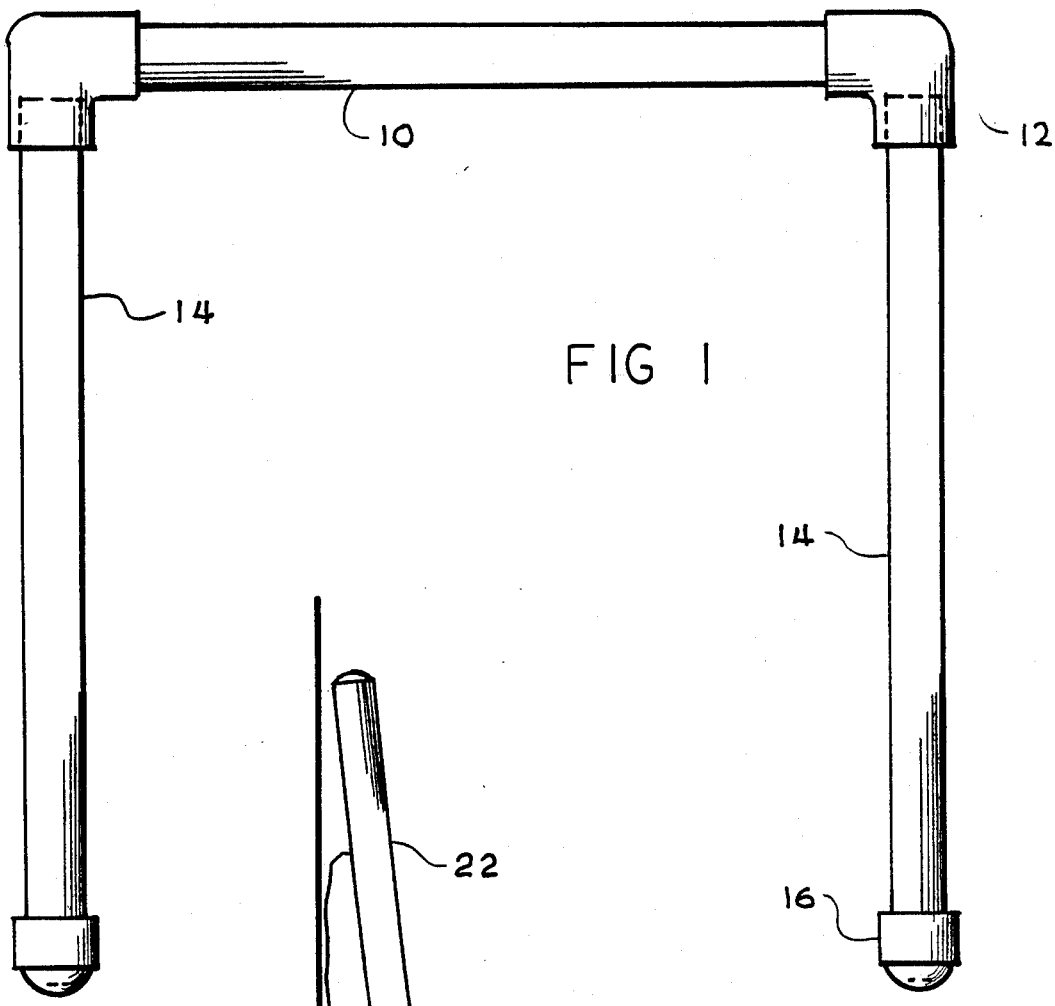
FIG. 1 shows a front view of the seat frame.

The form of this invention which has been constructed and field tested on several back packing trips is an independent U-shaped seat frame FIG. 1, constructed of ½" plastic pipe and fittings. The legs of the frame are capped with plastic end caps which have holes in the end 16. Two #6 fillister tapping screws have been screwed into the lower middle cross bar of the back frame to match the holes in the plastic end caps, FIG. 3.

To assemble: loosen the shoulder straps 24 of the backpack, hold the cross member of the seat frame against the underside of the shoulder straps and about 12" out from the pack frame 22. Position the end caps 16 over the fillister screw heads 18. Tighten the shoulder straps 26.

Figure 2:
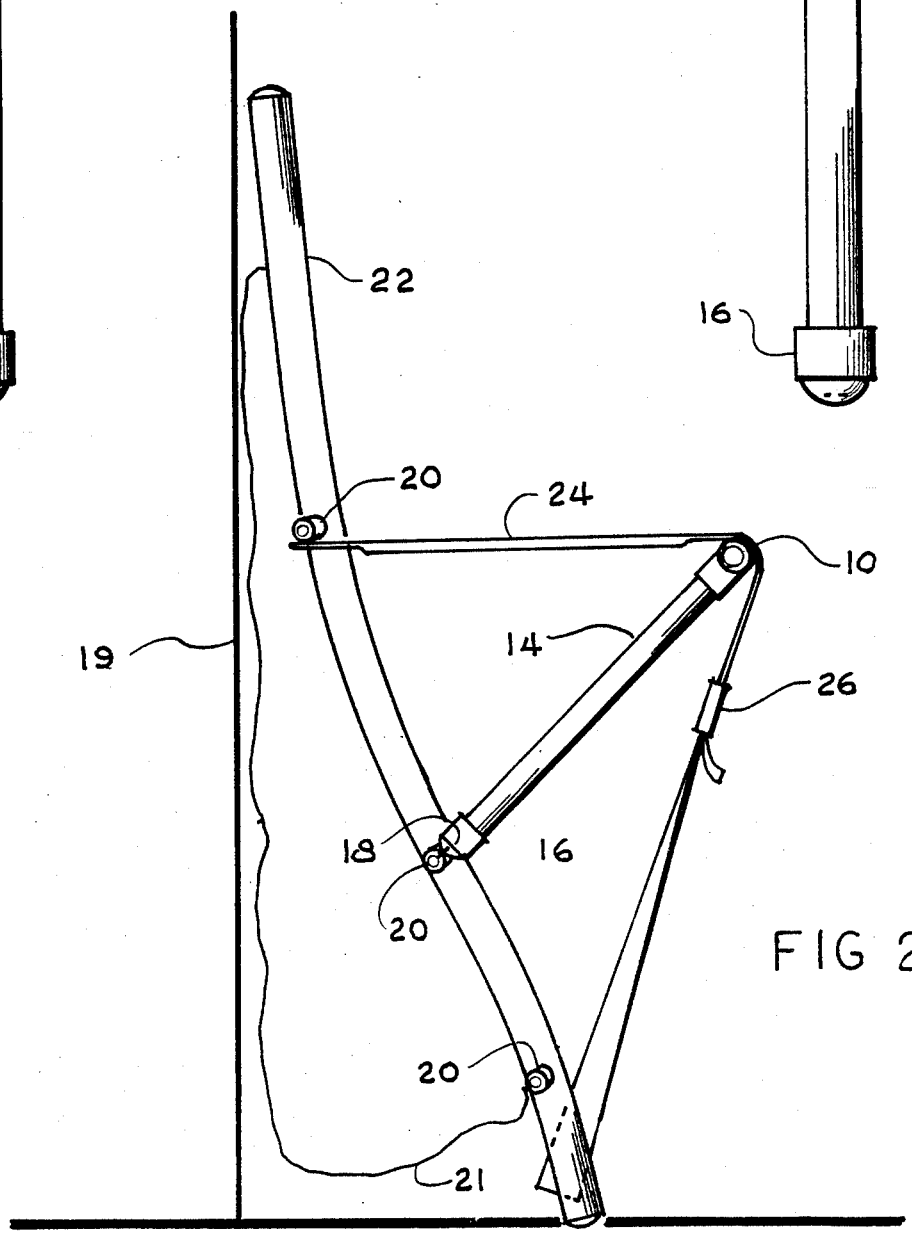
FIG. 2 shows a vertical cross-section of a typical backpack with seat frame in place. The backpack is shown leaning against a wall and ready for use as a seat.

To use: lean the assembled backpack seat, FIG. 2, against any vertical surface 19 with the bottom of the pack frame about 10 to 12 inches out. You now have a sturdy, comfortable seat with a back.

To disassemble: loosen the shoulder straps 24, remove the seat frame. Pull legs 14 from pipe elbows 12 and tie the three pieces together for carrying.

Photograph: a picture of this preferred assembly has been included on a separate sheet to expedite the review.

This invention is a device which converts a backpack into a seat.

I claim:

1. A convertible pack frame for use as a seat, the frame including a main frame for supporting a pack and including shoulder straps to support the main frame and pack, the shoulder straps being attached at their ends on the main frame, and a U-shaped secondary frame attached to the main frame when it is desired to convert the device to a seat, said secondary frame being attached to the main frame at a location between the ends of the shoulder straps such that when the secondary frame is attached, the shoulder straps can be positioned thereon to form a horizontal seat member with the tension of the shoulder straps aiding to hold the secondary frame in position on the main frame.

2. The backpack frame structure of claim 1 including the attachment of the secondary frame to the main frame is a pivot pin and the secondary frame can be folded, out to form a seat or laid back against the main frame while hiking.

3. The backpack frame structure of claim 1 including the attachment of the secondary frame is a pocket formed on the pack member when the main frame is an internal pack frame.

* * * * *